US011421618B2

(12) United States Patent
Storm et al.

(10) Patent No.: US 11,421,618 B2
(45) Date of Patent: Aug. 23, 2022

(54) METHOD FOR DETECTING VALVE LEAKAGE IN A COMBUSTION ENGINE

(71) Applicant: Volvo Car Corporation, Gothenburg (SE)

(72) Inventors: Andreas Storm, Gothenburg (SE); Niklas Särnberger, Molndal (SE); Fredrik Fridmar, Ulricehamn (SE)

(73) Assignee: Volvo Car Corporation, Gothenburg (SE)

( * ) Notice: Subject to any disclaimer, the term of this patent is extended or adjusted under 35 U.S.C. 154(b) by 0 days.

(21) Appl. No.: 17/202,620

(22) Filed: Mar. 16, 2021

(65) Prior Publication Data

US 2021/0293197 A1 Sep. 23, 2021

(30) Foreign Application Priority Data

Mar. 18, 2020 (EP) ..... 20163812

(51) Int. Cl.
*F02D 41/22* (2006.01)
*F02D 41/00* (2006.01)
*F02D 41/14* (2006.01)

(52) U.S. Cl.
CPC ..... *F02D 41/22* (2013.01); *F02D 41/0087* (2013.01); *F02D 41/1401* (2013.01); *F02D 2200/0406* (2013.01)

(58) Field of Classification Search
CPC .. F02D 41/22; F02D 41/0087; F02D 41/1401; F02D 2200/0406; F02D 41/123; F02D 41/221; G01M 15/106; G01M 15/042; G01M 15/102
USPC ..... 73/114.76, 114.37; 701/101, 107, 114
See application file for complete search history.

(56) References Cited

U.S. PATENT DOCUMENTS 2,766,616 A * 10/1956 Potter ..... G01L 23/24 346/5
4,291,382 A * 9/1981 Full ..... G01M 15/09 702/140
4,424,709 A 1/1984 Meier, Jr. et al.
(Continued)

FOREIGN PATENT DOCUMENTS

EP 1580407 A1 9/2005
EP 3536939 A1 9/2019
(Continued)

OTHER PUBLICATIONS

Sep. 14, 2020 European Search Report issued on International Application No. 20163812.

*Primary Examiner* — Sizo B Vilakazi
*Assistant Examiner* — Brian R Kirby
(74) *Attorney, Agent, or Firm* — Clements Bernard Walker; Christopher L. Bernard

(57) ABSTRACT

A method for detecting valve leakage of a least one valve at a cylinder intake manifold or exhaust manifold of a vehicle engine, the method comprising: acquiring a set of pressure data points indicative of the pressure in the cylinder intake manifold or exhaust manifold for crankshaft angular positions covering crankshaft angular rotation degrees such that each of the at least one valve has opened at least one time; and determining at least one test value based on the set of pressure data points, wherein a valve leakage is detected based on a comparison of the at least one test value to a threshold value.

17 Claims, 7 Drawing Sheets

(56) References Cited

U.S. PATENT DOCUMENTS 4,574,265 A * 3/1986 Kaiser ..... F02D 41/222 701/99
4,644,784 A * 2/1987 Okano ..... G01L 23/24 123/480
5,069,063 A * 12/1991 Chrobaczek ..... G01D 3/02 73/114.37
5,355,713 A * 10/1994 Scourtes ..... G01M 15/09 73/114.76
5,617,337 A * 4/1997 Eidler ..... G01D 18/00 73/114.18
5,721,375 A * 2/1998 Bidner ..... F02D 41/0087 701/101
5,780,730 A * 7/1998 Scourtes ..... G01M 15/106 73/114.37
6,499,470 B2 * 12/2002 Takagi ..... F02D 17/02 123/481
6,752,128 B2 6/2004 Ozeki et al.
7,004,149 B2 * 2/2006 Yashiro ..... F02M 35/1038 73/114.37
7,270,116 B2 * 9/2007 Pauli ..... F02B 29/02 123/480
7,661,298 B2 * 2/2010 Hartmann ..... F02D 41/221 73/114.26
7,921,709 B2 * 4/2011 Doering ..... F02D 41/221 73/114.37
8,006,670 B2 * 8/2011 Rollinger ..... F02D 41/221 123/481
8,286,471 B2 * 10/2012 Doering ..... F02D 41/0087 73/114.79
8,428,809 B2 * 4/2013 Roberts ..... F02D 9/02 73/114.37
8,667,835 B2 * 3/2014 Doering ..... F02D 41/0087 73/114.79
9,116,075 B2 * 8/2015 Melzig ..... F02D 41/221
9,562,470 B2 2/2017 Younkins et al.
9,638,119 B2 * 5/2017 Hagari ..... F02D 41/145
9,759,213 B2 9/2017 Bassett et al.
9,835,522 B2 * 12/2017 Chen ..... F02M 35/1038
9,890,732 B2 * 2/2018 Younkins ..... G01L 23/08 73/114.26
9,995,652 B1 * 6/2018 Chen ..... F02D 41/0002
10,161,344 B2 12/2018 Dudar
10,222,289 B2 3/2019 Matsukawa et al.
10,316,767 B2 * 6/2019 Park ..... G01M 15/104
10,704,463 B2 * 7/2020 Iannone ..... F02D 41/221
2005/0039721 A1 * 2/2005 Truscott ..... F02P 5/153 123/406.27
2006/0229798 A1 * 10/2006 Fukuzawa ..... F02D 41/222 73/114.37
2008/0236267 A1 * 10/2008 Hartmann ..... F02D 41/221 73/114.37
2009/0204283 A1 * 8/2009 Roberts ..... F01L 13/0015 701/31.4
2010/0126259 A1 * 5/2010 Vinci ..... G01M 15/05 73/114.23
2011/0137509 A1 * 6/2011 Sarac ..... F02D 41/221 73/114.37
2013/0333457 A1 * 12/2013 Schaedel ..... G01M 15/106 73/114.37
2014/0245823 A1 * 9/2014 Melzig ..... G01M 15/106 73/114.76
2016/0116371 A1 * 4/2016 Chen ..... F02M 35/1038 73/114.37
2016/0265452 A1 * 9/2016 Martin ..... F02D 41/222
2017/0101956 A1 * 4/2017 Younkins ..... F02D 41/1401
2017/0314481 A1 * 11/2017 Karunaratne ..... F02M 26/43
2018/0283976 A1 10/2018 Shiwa et al.
2019/0128203 A1 * 5/2019 Shrivastava ..... F02D 41/1446
2019/0211768 A1 * 7/2019 Dudar ..... F02D 41/18
2019/0249618 A1 * 8/2019 Dudar ..... F01L 13/0005

FOREIGN PATENT DOCUMENTS

JP 2015166554 A 9/2015
WO 2016065047 A1 4/2016

* cited by examiner

METHOD FOR DETECTING VALVE LEAKAGE IN A COMBUSTION ENGINE

CROSS-REFERENCE TO RELATED APPLICATION

The present disclosure claims the benefit of priority of co-pending European Patent Application No. 20163812.9, filed on Mar. 18, 2020, and entitled "A METHOD FOR DETECTING VALVE LEAKAGE IN A COMBUSTION ENGINE," the contents of which are incorporated in full by reference herein.

TECHNICAL FIELD

The present disclosure generally relates to a method for detecting valve leakage in at least one valve at a cylinder intake manifold or exhaust manifold of a vehicle engine.

BACKGROUND

In a typical combustion engine, one set of valves is often arranged to control the flow of an air/fuel mixture into the cylinders of the combustion engine, and another set of valves to control the release of exhaust gases from the cylinder. Camshafts are often used for controlling the intake and exhaust valves in the combustion engines. As the camshaft rotates, the cams move around the rotation axis of the shaft and causes the valves to open or close depending on the rotational position of the camshaft.

A crankshaft controls the stroke of a piston in the cylinder according to a combustion cycle of the engine. The motion of the crankshaft is synchronized with the motion of the camshaft in order to timely open and close the valves during the combustion cycle of the engine.

It is important that the valves operate accurately and with no leakage. Valve leakage during engine operation can for example cause engine misfire, damage to exhaust aftertreatment systems, intake manifold excess heat. However, these events may be avoided if valve leakage is detected in time.

SUMMARY

The subject-matter of the present disclosure generally relates to a method for detecting valve leakage of a least one valve at a cylinder intake manifold or exhaust manifold of a vehicle engine.

According to a first aspect of the present disclosure, there is provided a method for detecting valve leakage in a least one valve at a cylinder intake manifold or exhaust manifold of a vehicle engine, the method comprising: acquiring a set of pressure data points indicative of the pressure in the cylinder intake manifold or exhaust manifold for crankshaft angular positions covering crankshaft angular rotation degrees such that each of the at least one valve has opened at least one time; and determining at least one test value based on the set of pressure data points, wherein a valve leakage is detected based on a comparison of the at least one test value to a threshold value.

The inventors realized that if a set of pressure data points is sampled for a time duration and the pressure data is correlated with the crankshaft angular positions, the pressure data points as a function of crankshaft angular positions provides a periodic pattern, e.g. a sine curve. At steady state engine operating conditions and without any valve leakages the periodic pattern is relatively steady. The inventors realized that in the event of valve leakage, deviations appear in the periodic pattern. Based on recognizing the deviations a valve leakage is identified.

To this end, the pressure data points are sampled as a function of crankshaft angle position.

Further, a test value is determined based on the set of pressure data points. The test value reflects the deviation of the data pattern from a steady pattern indicative of a manifold without valve leakage.

For example, a pattern recognition algorithm may be applied to the set of pressure data points sampled as a function of crankshaft angle for determining the test value and for detecting a valve leakage.

Preferably, the crankshaft angular rotation of a complete engine operation cycle is 720 degrees. Thus, the pressure data points may be correlated to crankshaft angular rotation degrees in the range 0-720 degrees, i.e. two complete revolutions of the crankshaft. In this way, for a four-stroke engine, it is ensured that each of the intake manifold valves or each of the exhaust manifold valves have opened once.

Further, by correlating the test value to a crankshaft angular position, it can be determined which of the valves of the engine that are leaking.

The embodiments herein may be applied to the valves at the cylinder intake manifold. Analogously, the embodiments herein may be applied to the valves at the cylinder exhaust manifold.

Further features of, and advantages with, embodiments of the present disclosure will become apparent when studying the appended claims and the following description. The skilled person realize that different features of the present disclosure may be combined to create embodiments other than those described in the following, without departing from the scope of the present disclosure.

BRIEF DESCRIPTION OF DRAWINGS

These and other aspects of the present disclosure will now be described in more detail, with reference to the appended drawings showing example embodiments of the present disclosure, wherein.

DETAILED DESCRIPTION

Figure 1A:
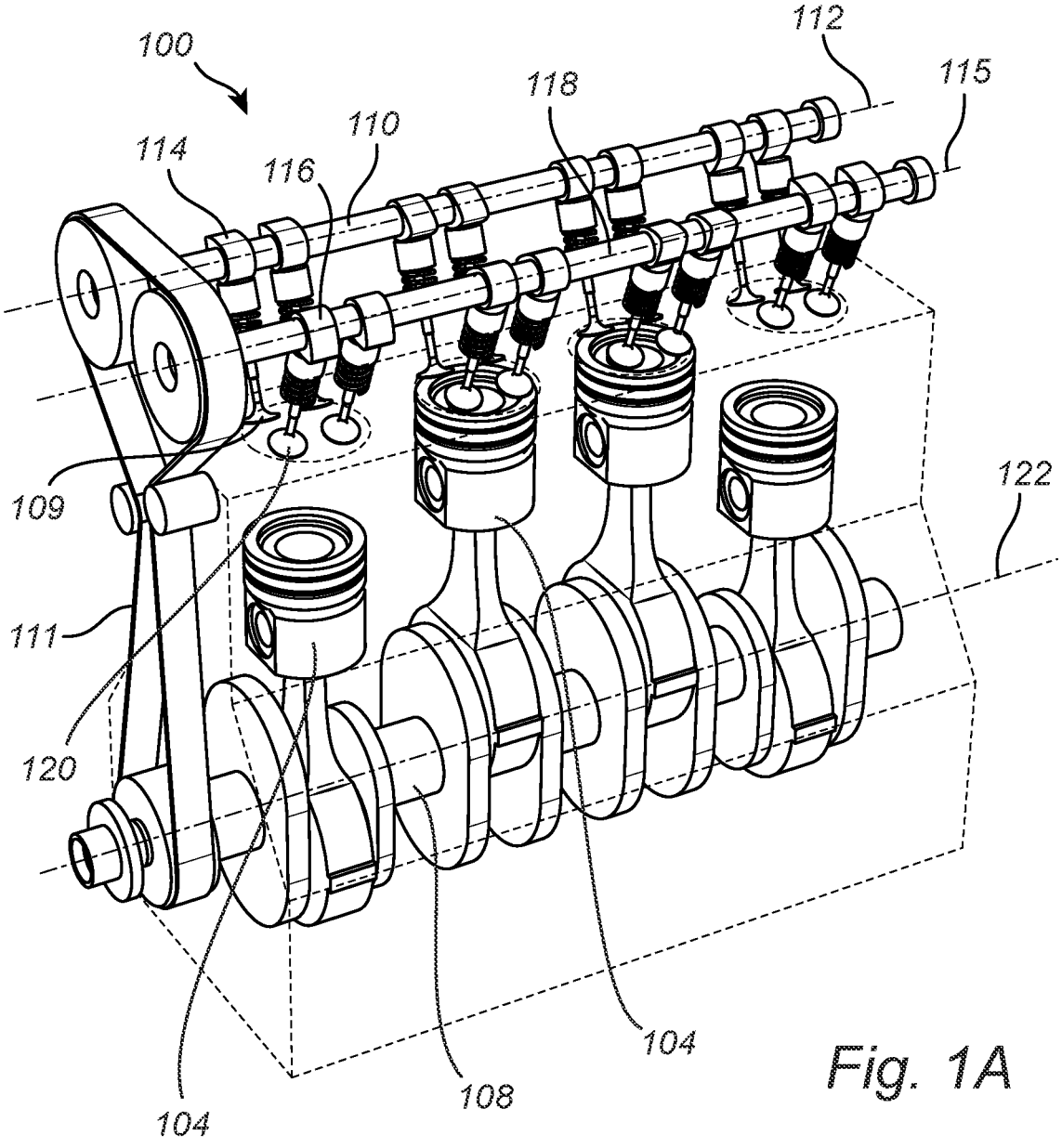
FIG. 1A conceptually illustrates an exemplary combustion engine for a vehicle.

In the present detailed description, various embodiments of a method according to the present disclosure are described. However, the methods of the present disclosure may be embodied in many different forms and should not be construed as limited to the embodiments set forth herein; rather, these embodiments are provided for thoroughness and completeness, and to fully convey the scope of the disclosure to the skilled person. Like reference characters refer to like elements throughout.

FIG. 1A conceptually illustrates an exemplary combustion engine 100 for a vehicle. The combustion engine comprises multiple cylinders (not shown) and multiple pistons 104. In each of the cylinder is a respective piston 104 arranged. The pistons 104 are forced to move in the respective cylinder by the combustion of fuel in the cylinder volume. The stroke motion of the piston in the cylinder is transferred to a crankshaft 108 for transferring propulsion power to the driveline (not shown) of the vehicle comprising the combustion engine 100.

Further, in order to allow an air-fuel mixture into the cylinder volume a valve 109 is configured to open an inlet to the cylinder volume at timed intervals. The timing is provided by a linking mechanism 111 (a so-called "timing belt") which is configured to rotate a first camshaft 110 about a rotation axis 112 such that a cam 114 of the camshaft 110 causes the first valve 109 to open and close in a synchronized manner with respect to the rotation of the crankshaft 108 and thereby with respect to the strokes of the piston 104. The valves 109 are arranged in an intake manifold of the engine 100.

Furthermore, a second camshaft 118 is configured to open and close a second valve 120. The timing of the operation of the second valves 120 is also is provided by the linking mechanism 111. Thus, the linking mechanism is configured to rotate the second camshaft 118 about a rotation axis 115 such that a cam 116 of the second camshaft 118 causes the second valve 120 to open and close in a synchronized manner with respect to the rotation of the crankshaft 108 and thereby with respect to the strokes of the piston 104.

The second valves 120 controls the outflow of exhaust from the cylinder volumes in a synchronized manner with the rotation of the crankshaft 108 and thereby with respect to the strokes of the piston 104. The second valves 120 are arranged in an exhaust manifold of the engine 100.

Overall, the timing of the opening and closing of the intake manifold valves 109 with respect to the rotation of the crankshaft 108 about its axis 122 is synchronized. Therefore, as the pressure in the intake manifold accommodating the intake valves 109 varies with the opening and closing of the intake manifold valves 109, the pressure in the intake manifold is also synchronized with the crankshaft rotation, and it is therefore possible to correlate the pressure in the intake manifold with the crankshaft angular positions to thereby produce a periodic pressure versus crankshaft angle pattern.

Analogously, the timing of the opening and closing of the exhaust manifold valves 120 with respect to the rotation of the crankshaft 108 about its axis 122 is synchronized. Therefore, as the pressure in the exhaust manifold accommodating the exhaust valves 120 varies with the opening and closing of the exhaust manifold valves 120, the pressure in the exhaust manifold is also synchronized with the crankshaft rotation. Thus, also for the exhaust manifold pressure, a periodic pattern of pressure versus crankshaft angle is producible.

Crankshaft angular positions are rotational orientations of the crankshaft 108 about its rotation axis 122.

Figure 1B:
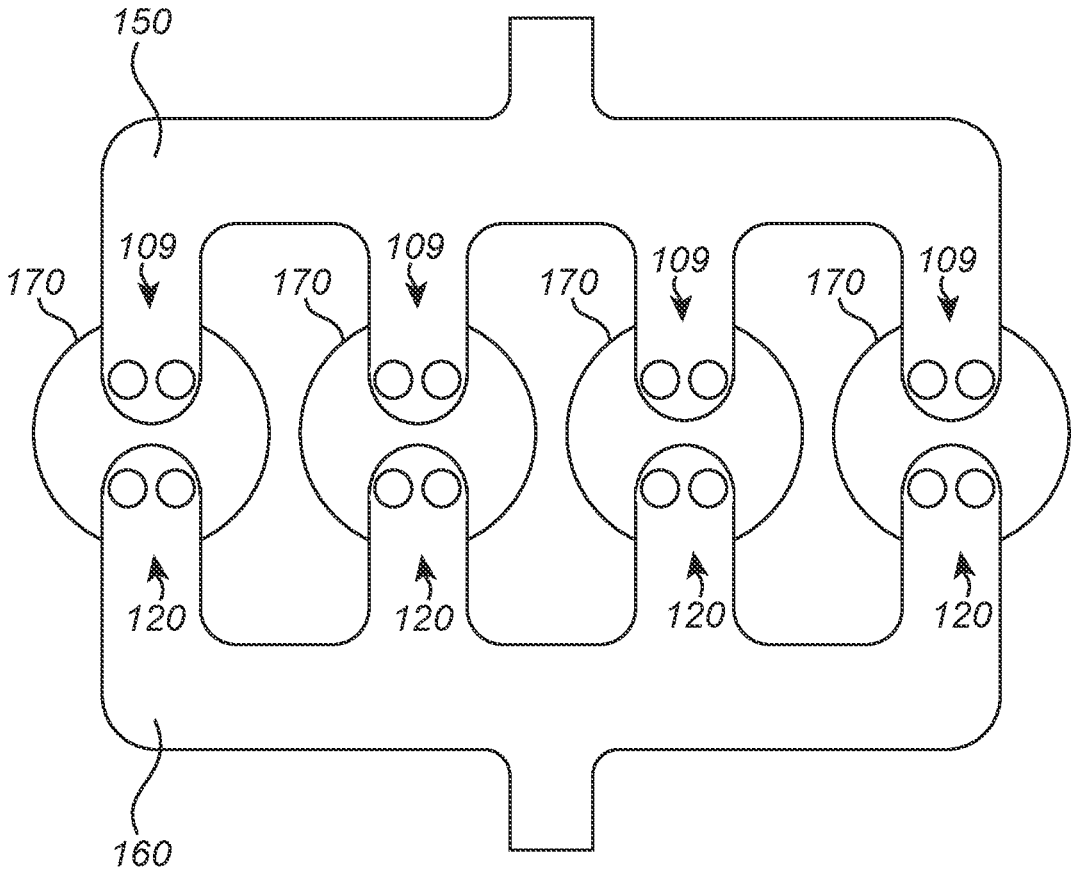
FIG. 1B schematically illustrates an intake manifold and an exhaust manifold with respective valves for a vehicle engine comprising a set of cylinders.

FIG. 1B conceptually illustrates the intake manifold 150 and the exhaust manifold 160. The intake manifold 150 have associated intake valves 109 at each of the cylinders 170 and the exhaust manifold 160 has associated exhaust valves 120 at each of the cylinders 170. As mentioned above, the valves 109 are arranged to control intake of air/fuel mixture into the cylinders 170 and the valves 120 are arranged to control the outflow of exhaust gas from the cylinders 170. The pressure in the intake manifold 150 are in embodiments herein measured. In other embodiments, the pressure in the exhaust manifold 160 is measured.

Generally, the intake manifold provides the air and fuel mix in the cylinder volumes, and the exhaust manifold leads the exhaust gas from the cylinders to an aftertreatment system.

Accordingly, as was realized by the inventors, in an engine with no valve leakage, the pressure in the intake manifold or exhaust manifold with respect to crankshaft angular position is relatively reproducible and predictable when the engine is steadily operative. However, if one or several of the valves in e.g. the intake manifold is leaking, the pattern of the pressure in the intake manifold with respect to crankshaft angular position deviates from the pattern produced with no leaking valve.

That the engine is operating steadily relates to that no gearshift is presently occurring, the engine is warm, and that the engine speed and load is within normal operating range.

Figure 2:
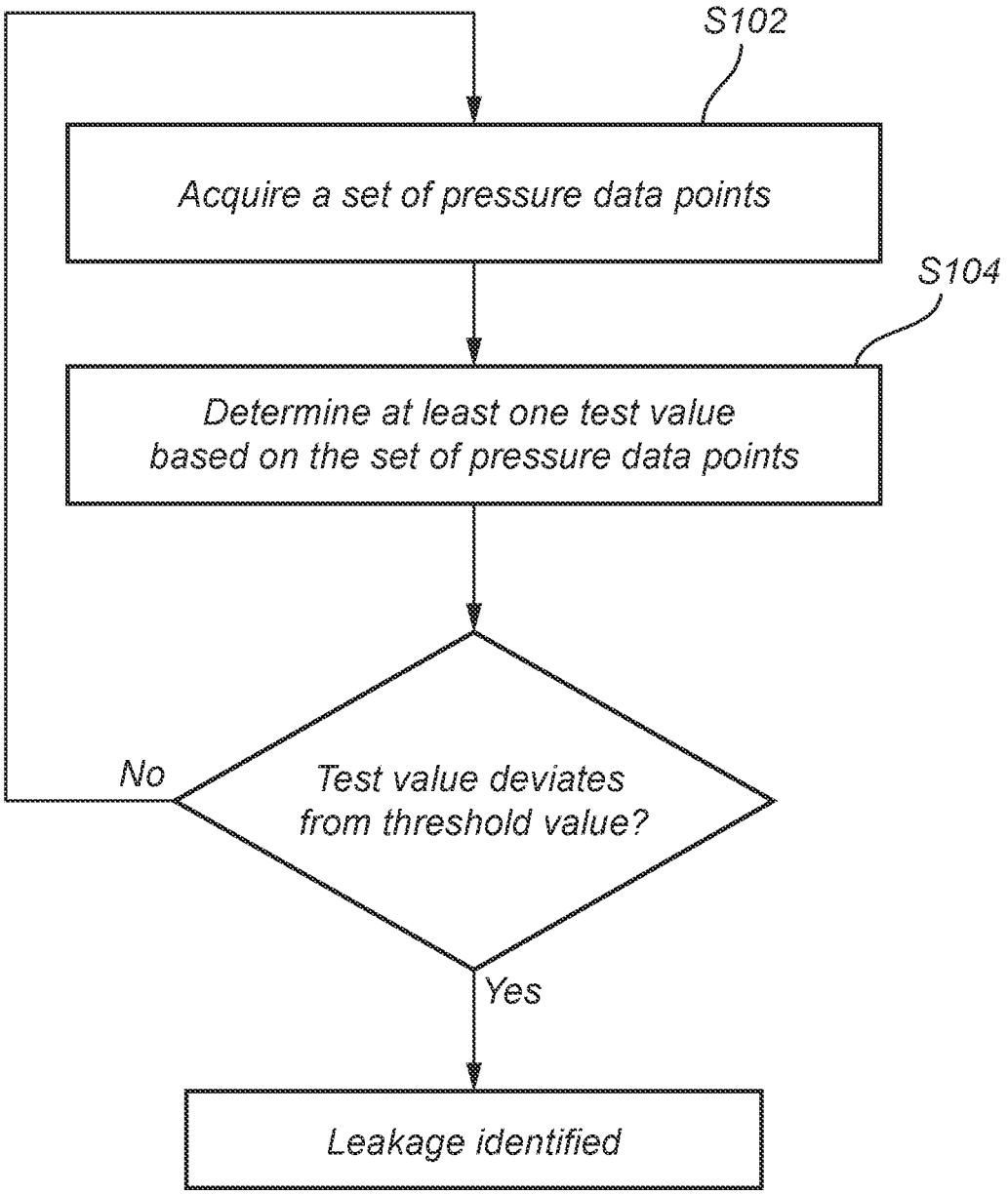
FIG. 2 is a flow-chart of method steps according to embodiments of the present disclosure.

FIG. 2 is a flow-chart of method steps according to embodiments of the present disclosure. Herein, a method is disclosed for detecting valve leakage of a least one valve at a cylinder intake manifold or exhaust manifold of a vehicle engine.

The method comprises a step S102 of acquiring a set of pressure data points indicative of the pressure in the cylinder intake manifold or exhaust manifold for crankshaft angular positions covering crankshaft angular rotation degrees such that each of the at least one valve has opened at least one time. In order to be able to evaluate each of the valves 109, or each of the valves 120, pressure data points for a sufficient range of angular positions of the crankshaft that covers the opening of each valve is acquired.

Further, in step S104, determining at least one test value based on the set of pressure data points. A valve leakage is detected based on a comparison of the at least one test value to a threshold value. For example, if the test value exceeds a threshold value, it may be concluded that the intake manifold has a leaking valve, whereby a leaking valve is identified. Depending on the test value and on the selected threshold, a leaking valve may be considered detected or identified if the test value is below a threshold value. In some embodiments is one test value per cylinder determined.

If it is concluded that no leaking valve is detected, the method may return to step S102. If a leak is detected, actions may be taken, and the method may also in this case return to step S102. The method may be continuously repeated and be performed in real-time, i.e. concurrently with pressure data collection.

In the explicitly described embodiments it is mainly referred to the intake manifold pressure. However, the embodiments of the present disclosure may equally well and analogously be applied to the exhaust manifold pressure.

Figure 3:
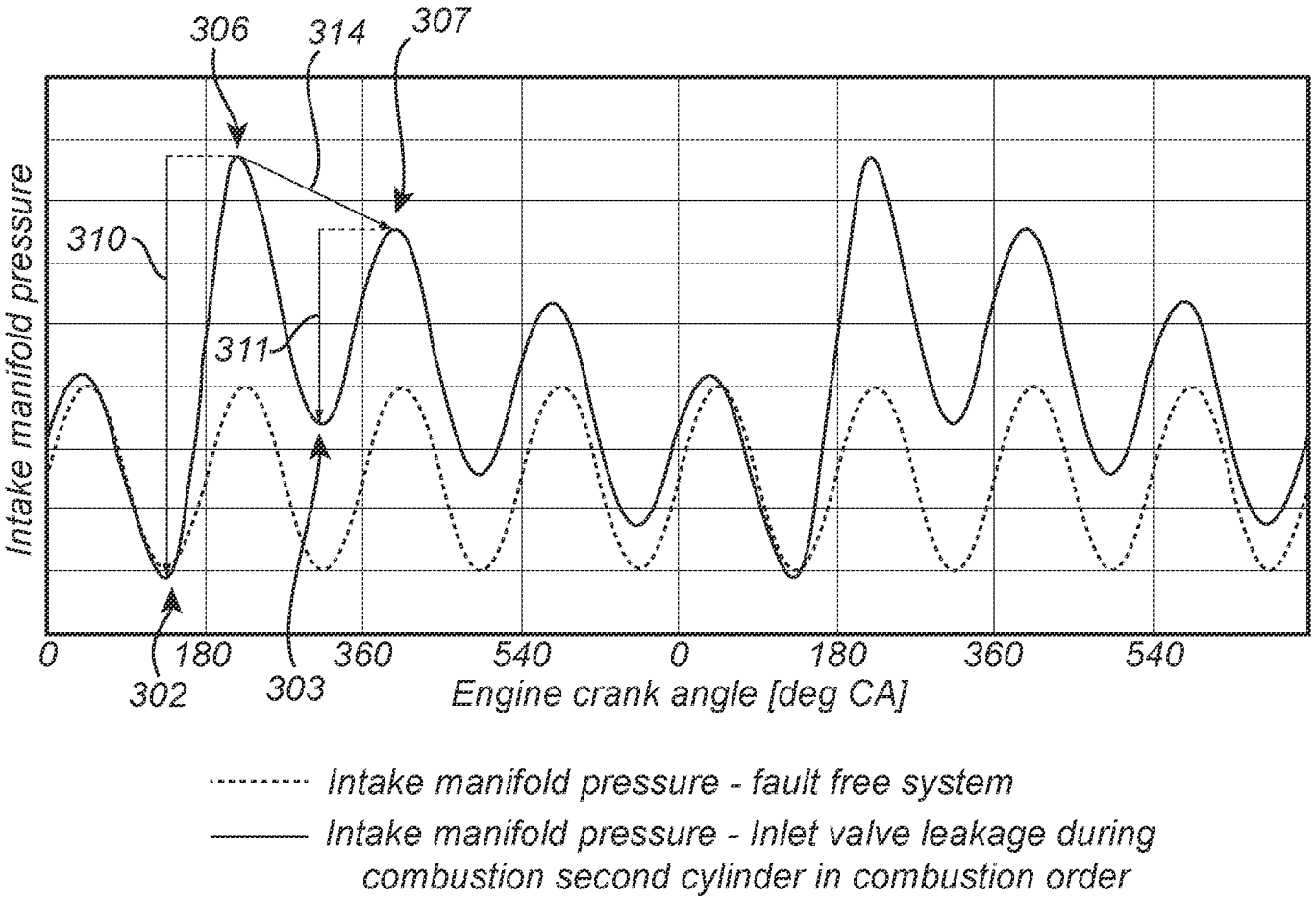
FIG. 3 illustrates a graph of example pressure data points for a deviating pattern and a normal pattern.
Figure 4:
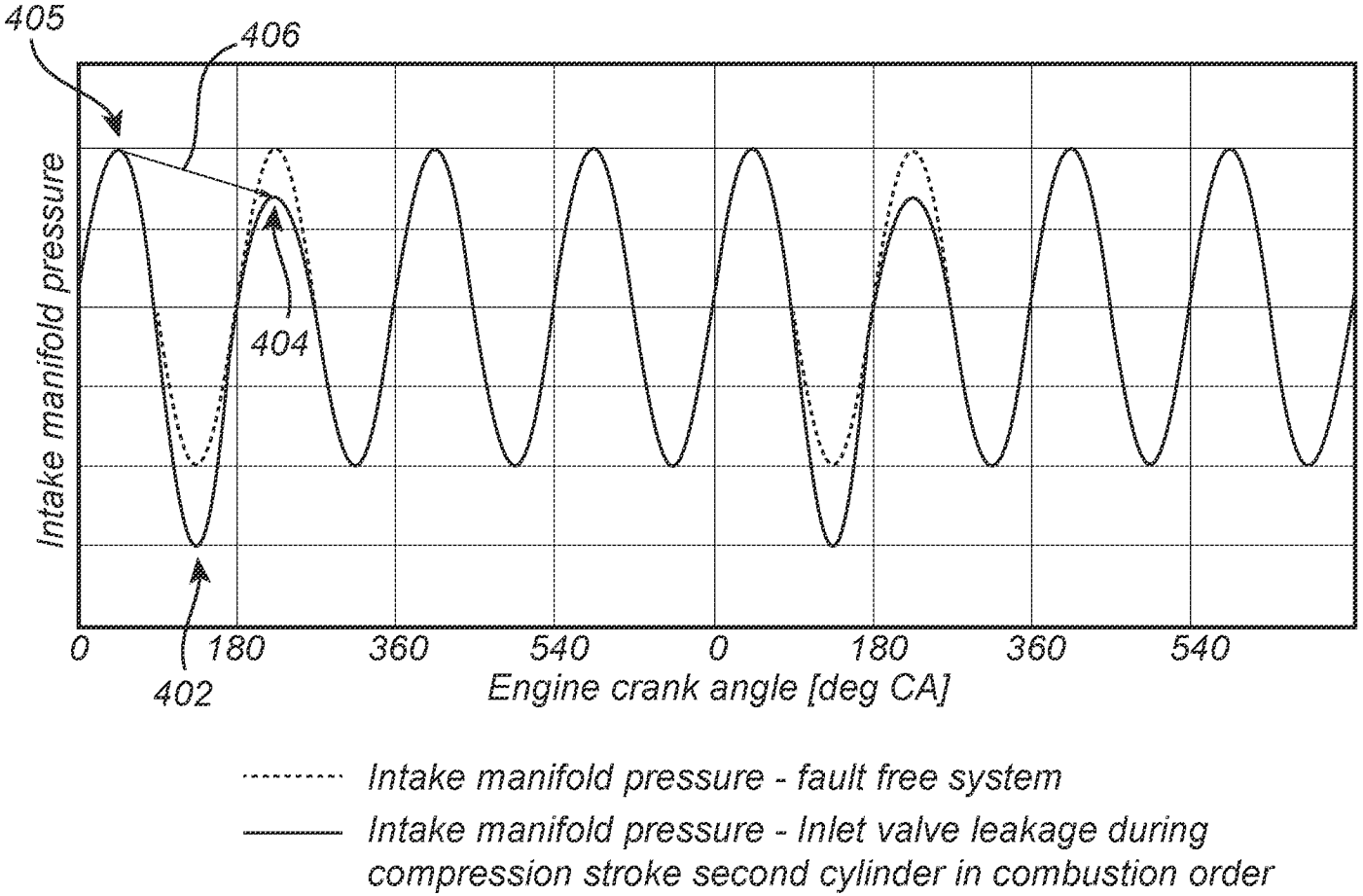
FIG. 4 illustrates a graph of example pressure data points for a deviating pattern and a normal pattern.
Figure 5:
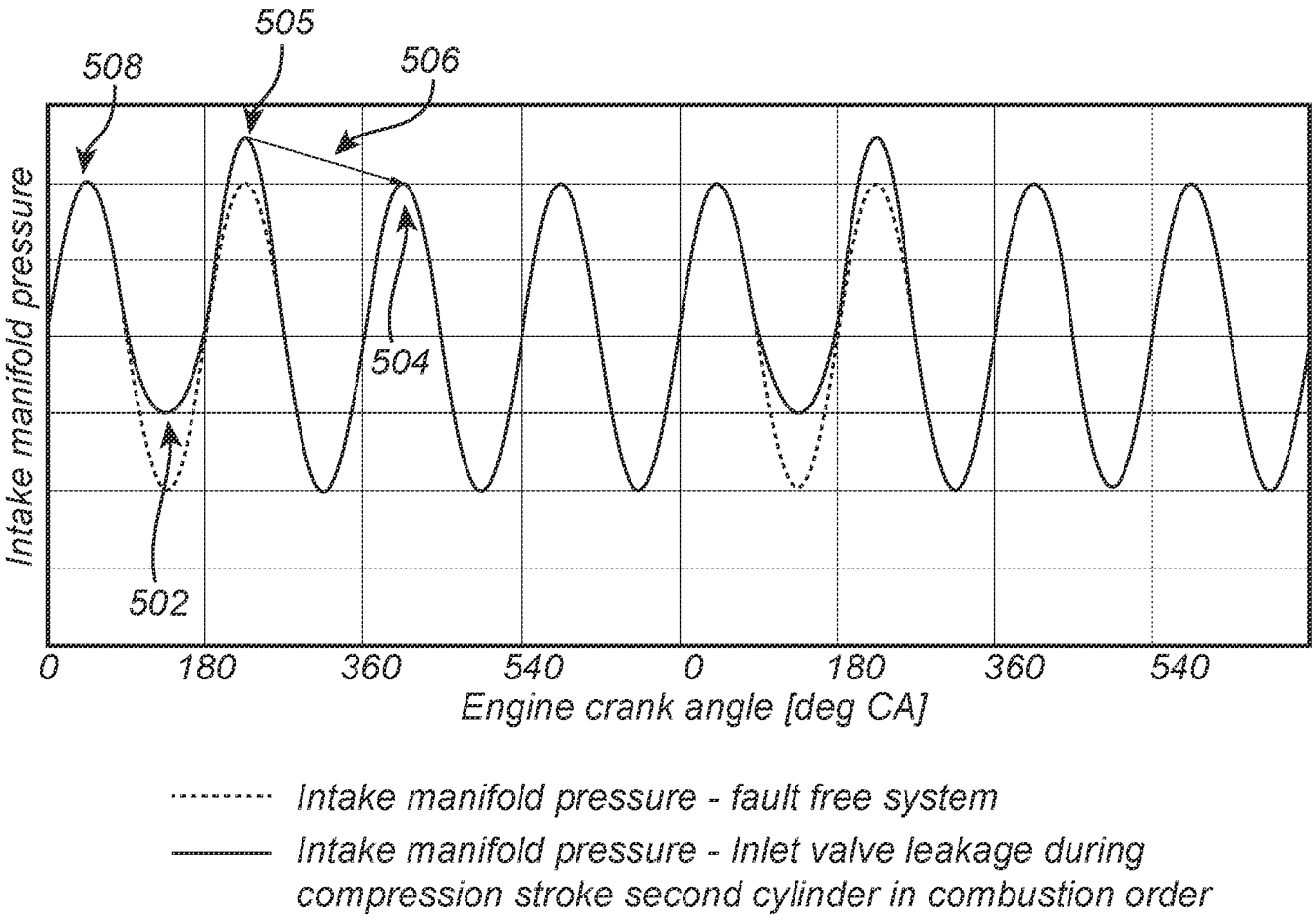
FIG. 5 illustrates a graph of example pressure data points for a deviating pattern and a normal pattern.

The set of pressure data points is advantageously sampled as a function of crankshaft angular positions, as is illustrated in FIGS. 3-5.

FIG. 3 is a graph illustrating example pressure data points indicating intake manifold pressure versus crankshaft angle position, for a fault free intake manifold, dashed line, and for an intake manifold having a leaking valve, solid line. The pressure for the fault free intake manifold is periodic and with a stable amplitude, i.e. the amplitude of the periodic pattern shown as the dashed line is the same for the entire range of crankshaft angle position on the x-axis of the graph. Here the shown range of crankshaft angle is 1440 degrees, however, for embodiments herein 720 degrees is enough for performing valve leakage detection.

The pressure data shown in FIG. 3 is for a four cylinder, four-stroke engine, and during 720 degrees rotation of the crankshaft each of the inlet valves 109 has opened once. One period in the patterns represent the opening and closing of a valve (inlet or exhaust) for one of the cylinders of the engine. Generally, the pressure decreases in the intake manifold during valve opening for filling stroke and increases at valve closure prior to next cylinder valves open.

The pressure data points shown in the solid line of in FIG. 3 represents the intake manifold pressure with an inlet valve leakage during combustion in the second cylinder in the combustion order. This is understood from the deviating pattern of the solid line that begins at the second peak at local maximum 306, i.e. corresponding to the inlet valve in the second cylinder. Further, a leak during the combustions means that the high pressure from the cylinder pressurizes also the intake manifold, whereby a pressure offset is caused to the solid curve representing the pressure in the intake manifold. The offset falls relatively slowly back to the normal level, but appears again the next time combustion occurs in the second cylinder.

The pressure for the leaking intake manifold, shown in the solid line, deviates from the pressure of the fault free system represented by the dashed line. For example, the amplitude of the periodic pattern for the pressure of the leaking intake manifold, solid line, varies over 720 degrees. Several deviations can be found in the pattern (solid) representing the faulty intake manifold from the pattern of the fault free intake manifold.

Accordingly, embodiments of the present disclosure are based on the realization that the pressure as a function of crankshaft angle, in an intake or exhaust manifold having a leaking valve deviates from the pressure as a function of crankshaft angle, in a fault free intake or exhaust manifold. Detecting a leaking valve in time may prevent engine misfires, damage to aftertreatment systems, and excess heat in the intake manifold.

In order to evaluate the leak status of the valves in the intake manifold a test value is determined based on the pressure data points. A test value may be determined by performing pattern recognition on the pressure data points. The test value may in such case reflect the degree of deviation of the pressure data points from pressure data points of a fault free intake manifold. The pattern recognition algorithm may have been taught to recognize patterns that represent the pressure pattern for intake manifolds with leaking valves. The test value may reflect the similarity score of the pattern recognition algorithm output with known patterns representing the pressure pattern for intake manifolds with leaking valves.

Another example test value may be based on a difference between pressure data points. For example, the pressure difference between local minima 302 and 303 in the pressure data points versus crankshaft angle would indicate that the pressure data points deviate from the pressure data of a fault free intake manifold for which such difference would be close to zero. In a similar way may the pressure difference between local maxima 306 and 307 in the pressure data points versus crankshaft angle indicate that the pressure data points deviate from the pressure data of a fault free intake manifold.

As a further example, the test value may be based on a pressure difference between local maximum and local minimum pressure data points in the set of pressure data points. For example, if the first difference 310 between the local maximum 306 and the adjacent local minimum 302 deviates from a second difference 311 between the local maximum 307 and the adjacent local minimum 303 by more than a threshold value, the intake manifold may be concluded to comprise a leaking valve.

Another possible implementation is that the test value is based on a derivative of pressure data points with respect to crankshaft angular positions. For example, the test value may be based on a derivative between local maximum pressure data points 306 and 307 in the set of pressure data points as a function of crankshaft angular positions. Thus, the inclination of the line 314 between local maximum points may be the test value. In the dashed curve representing a fault free intake manifold such derivative would be close to zero. Thus, if the inclination of line 314 deviates by some threshold from zero, the intake manifold may be concluded to comprise a leaking valve. Analogously, the test value may be based on a derivative between local minimum pressure data points, e.g. 302 and 303 in the set of pressure data points with respect to crankshaft angular positions.

Note that other types analysis may be performed for determining a test value that may indicate a leaking valve. For example, it is conceivable to perform a Fourier analysis to detect frequency components of the pressure data points. For a fault free intake manifold or exhaust manifold, the Fourier analysis would typically show a single dominant frequency component, whereas a Fourier analysis of pressure data points sampled from a faulty intake manifold would include more frequency components.

FIGS. 4 and 5 are graphs illustrating other examples of pressure data points indicating intake manifold pressure versus crankshaft angle position, for a fault free intake manifold, dashed line, and for an intake manifold having a leaking valve, solid line.

In FIG. 4, local minimum is denoted 402 and local maxima are denoted 404 and 405. For a test value of a derivative, the inclination of the line 406 between adjacent local maxima may be used. The pressure data points in the solid line represents example intake manifold pressure for an intake manifold with an inlet valve leak during a compression stroke in the second cylinder in the combustion order.

In FIG. 5, local minimum is denoted 502 and local maxima are denoted 504, 505, and 508. For a test value of a derivative, the inclination of the line 506 between adjacent local maxima may be used. The pressure data points in the dashed line represents another example of intake manifold pressure for an intake manifold with an inlet valve leak during a compression stroke in the second cylinder in the combustion order.

The patterns arising in the pressure data shown in FIGS. 3-5 reflect the number of cylinders in the engine. Since the combustion cycle of engines is known, it is possible to relate the periods of the periodic patterns in the pressure data to which valve is being opened at a certain crankshaft angle position. For a four-cylinder engine, there will be four periods in the periodic pressure pattern, if the crankshaft angle range covers two revolutions of the crankshaft, e.g. 720 degrees. Based on this, it can be determined that the first peak in the periodic pattern corresponds to a valve opening to the first cylinder of the engine.

Accordingly, when the vehicle engine comprises a set of cylinders each having at least one associated valve at the respective intake manifold or exhaust manifold, the method may comprise determining a test value for each of the cylinders and determining which of the cylinders that has an associated leaking valve based on which of the test values that deviates from the threshold value. For example, referring now to FIGS. 4 and 5, a test value related to the second local maximum 404, see 505 in FIG. 5, deviates from the previous local maximum 405, see 508 in FIG. 5, it can be concluded that it is a valve associated with the second cylinder in the combustion order that is leaking.

In one embodiment, also related to when the vehicle engine comprises a set of cylinders each having at least one associated valve at the respective intake manifold or exhaust manifold, the method may comprise determining a test value for each of the cylinders and determining which of the cylinders that has an associated leaking valves based on which of the test values that deviates from the other test values. In other words, if test values associated with a respective cylinder are compared to each other, and one of the test values deviates more than a threshold value from the each of the other test values, then the cylinder associated with the one deviating test value may be concluded to be leaking.

In some embodiments, the fuel supply to a cylinder with a leaking valve is turned off.

Figure 6:
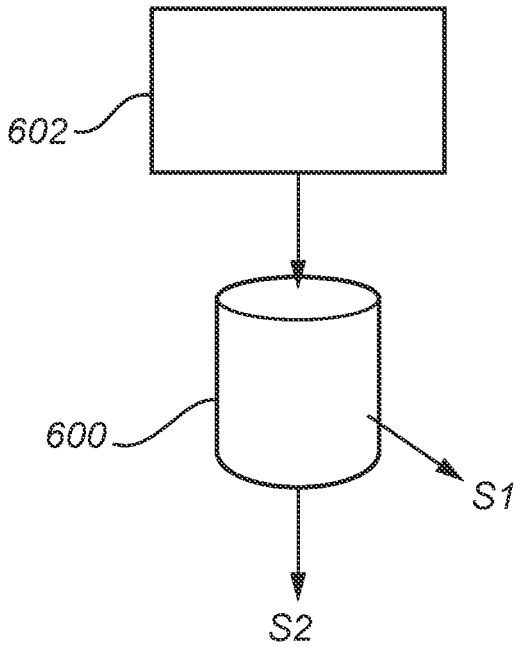
FIG. 6 is a box diagram illustrating a control unit operation scheme according to embodiments of the present disclosure.

FIG. 6 is a box diagram illustrating a control unit operation scheme according to embodiments of the present disclosure. The control unit 600 is configured for detecting a valve leakage of a least one valve in a cylinder intake manifold or exhaust manifold of a vehicle engine.

The control unit 600 is configured to acquire a set of pressure data points indicative of the pressure in the cylinder intake manifold or exhaust manifold at crankshaft angular positions covering crankshaft angular rotation degrees such that each of the at least one valve has opened at least one time. The pressure data points may be acquired from a pressure sensor 602 arranged in the intake manifold or exhaust manifold, depending on which manifold is monitored.

Further, the control unit 600 is configured to determine at least one test value based on the set of pressure data points, wherein a valve leakage is detected based on a comparison of the at least one test value to a threshold value. Thus, the control unit 600 may output a signal S1 indicative of a leaking valve.

Further, the control unit may be configured to, when a valve leakage is detected, provide a control signal S2 for turning off a fuel supply to a cylinder with the leaking valve.

In some embodiments, the control unit may be configured to apply a pattern recognition algorithm to the set of pressure data points for determining the test value and for detecting a valve leakage.

The control unit is preferably configured to sample the pressure data points as a function of crankshaft angular position.

Crankshaft angular positions may be a crankshaft angle, or crankshaft angular orientation.

A control unit may include a microprocessor, microcontroller, programmable digital signal processor or another programmable device, as well as be embedded into the vehicle/power train control logic/hardware. The control unit may also, or instead, include an application-specific integrated circuit, a programmable gate array or programmable array logic, a programmable logic device, or a digital signal processor. Where the control unit includes a programmable device such as the microprocessor, microcontroller or programmable digital signal processor mentioned above, the processor may further include computer executable code that controls operation of the programmable device. The control unit may comprise modules in either hardware or software, or partially in hardware or software and communicate using known transmission buses such as CAN-bus and/or wireless communication capabilities. Thus, communication between control units, or between control units and audio capturing devices, image capturing systems, image capturing devices, etc. may be accomplished by various means know in the art. For example, the communication may be hardwired, using known transmission buses such as CAN-bus and/or wireless communication capabilities.

A control unit of the present disclosure is generally known an ECU, electronic control unit.

There is further provided, according to aspects of the present disclosure, a vehicle comprising the control unit 600.

There is further provided, according to aspects of the present disclosure a computer program product comprising a computer readable medium having stored thereon computer program means for detecting valve leakage of a least one valve at a cylinder intake manifold or exhaust manifold of a vehicle engine, wherein the computer program product comprises: code for determining at least one test value based on an acquired set of pressure data points, wherein the set of pressure data points are indicative of the pressure in the cylinder intake manifold or exhaust manifold at known crankshaft angle positions; and code for detecting a valve leakage is based on relation between the at least one test value and a threshold value.

The computer program product may comprise code for applying a pattern recognition algorithm to the set of pressure data points for determining the test value and for detecting a valve leakage.

The methods described in the present disclosure are equally applicable to the cylinder intake manifold and to the cylinder exhaust manifold.

Accordingly, there is provided a method for detecting valve leakage in a least one valve at a cylinder intake manifold of a vehicle engine, the method comprising: acquiring a set of pressure data points indicative of the pressure in the cylinder intake manifold or exhaust manifold for crankshaft angular positions covering crankshaft angular rotation degrees such that each of the at least one valve has opened at least one time; and determining at least one test value based on the set of pressure data points, wherein a valve leakage is detected based on a comparison of the at least one test value to a threshold value.

In addition, there is provided a method for detecting valve leakage in a least one valve at a cylinder intake exhaust manifold of a vehicle engine, the method comprising: acquiring a set of pressure data points indicative of the pressure in the cylinder intake manifold or exhaust manifold for crankshaft angular positions covering crankshaft angular rotation degrees such that each of the at least one valve has opened at least one time; and determining at least one test value based on the set of pressure data points, wherein a valve leakage is detected based on a comparison of the at least one test value to a threshold value.

The person skilled in the art realizes that the present disclosure by no means is limited to the preferred embodiments described above. On the contrary, many modifications and variations are possible within the scope of the appended claims.

In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage. Any reference signs in the claims should not be construed as limiting the scope.

Various examples have been described. These and other examples are within the scope of the following claims.

The invention claimed is:

1. A method for detecting a valve leakage in a least one valve at a cylinder intake manifold or exhaust manifold of a vehicle engine, the method comprising:

acquiring, while operating the vehicle engine at steady state operating conditions such that the engine speed and load are within normal operating ranges that cause the engine to be warmed up, a set of pressure data points indicative of the pressure in the cylinder intake manifold or exhaust manifold for crankshaft angular positions covering crankshaft angular rotation degrees such that each of the at least one valve has opened at least one time, wherein the set of pressure data points is sampled as a function of crankshaft angular positions covering 720 degrees;

correlating the pressure data points with crankshaft angular positions in a range of 0-720 degrees; and determining at least one test value based on the set of pressure data points correlated with the crankshaft angular positions, the at least one test value reflecting a deviation of the set of pressure data points sampled as a function of crankshaft angular positions from a steady periodic pattern indicative of a manifold without leakage, wherein a valve leakage is detected based on a comparison of the at least one test value to a threshold value associated with the steady periodic pattern indicative of the manifold without leakage.

2. The method according to claim 1, further comprising applying a pattern recognition algorithm to the set of pressure data points for determining the test value and for detecting a valve leakage.

3. The method according to claim 1, wherein the test value is based on a difference between pressure data points.

4. The method according to claim 1, wherein the test value is based on a derivative of pressure data points with respect to crankshaft angular positions.

5. The method according to claim 4, wherein the test value is based on a derivative between local maximum pressure data points in the set of pressure data points with respect to crankshaft angular positions.

6. The method according to claim 4, wherein the test value is based on a derivative between local minimum pressure data points in the set of pressure data points with respect to crankshaft angular positions.

7. The method according to claim 1, wherein the test value is based on a difference between local maximum and local minimum pressure data points in the set of pressure data points.

8. The method according to claim 1, wherein the test value is based on a difference between local maximum pressure data points in the set of pressure data points.

9. The method according to claim 1, wherein the vehicle engine comprises a set of cylinders each having at least one associated valve at the respective intake manifold or exhaust manifold, the method comprises determining a test value for each of the cylinders and determining which of the cylinders that has an associated leaking valve based on which of the test values that deviates from the threshold value.

10. The method according to claim 1, wherein the vehicle engine comprises a set of cylinders each having at least one associated valve at the respective intake manifold or exhaust manifold, the method comprises determining a test value for each of the cylinders and determining which of the cylinders that has an associated leaking valve based on which of the test values that deviates from the other test values.

11. The method according to claim 1, further comprising:

when a valve leakage is detected, turning off a fuel supply to a cylinder with the leaking valve.

12. A control unit for detecting a valve leakage in a least one valve at a cylinder intake manifold or exhaust manifold of a vehicle engine, the control unit being configured to:

acquire, while the vehicle engine is operated at steady state operating conditions such that the engine speed and load are within normal operating ranges that cause the engine to be warmed up, a set of pressure data points indicative of the pressure in the cylinder intake manifold or exhaust manifold at crankshaft angular positions covering crankshaft angular rotation degrees such that each of the at least one valve has opened at least one time, wherein the set of pressure data points is sampled as a function of crankshaft angular positions covering 720 degrees;

correlating the pressure data points with crankshaft angular positions in a range of 0-720 degrees; and determine at least one test value based on the set of pressure data points correlated with the crankshaft angular positions, the at least one test value reflecting a deviation of the set of pressure data points sampled as a function of crankshaft angular positions from a steady periodic pattern indicative of a manifold without leakage, wherein a valve leakage is detected based on a comparison of the at least one test value to a threshold value associated with the steady periodic pattern indicative of the manifold without leakage.

13. The control unit according to claim 12, further configured to, when a valve leakage is detected, provide a control signal for turning off a fuel supply to a cylinder with the leaking valve.

14. The control unit according to claim 12, further configured to apply a pattern recognition algorithm to the set of pressure data points for determining the test value and for detecting a valve leakage.

15. A vehicle comprising the control unit according to claim 12.

16. A non-transitory computer readable medium comprising instructions stored in a memory and executed by a processor to carry out steps for detecting a valve leakage of a least one valve at a cylinder intake manifold or exhaust manifold of a vehicle engine, the steps comprising:

determining at least one test value based on an acquired set of pressure data points correlated with crankshaft angular positions in a range of 0-720 degrees and acquired while operating the vehicle engine at steady state operating conditions such that the engine speed and load are within normal operating ranges that cause the engine to be warmed up, wherein the set of pressure data points are indicative of the pressure in the cylinder intake manifold or exhaust manifold at known crankshaft angle positions covering at least 720 degrees, the at least one test value reflecting a deviation of the set of pressure data points as a function of crankshaft angular positions from a steady periodic pattern indicative of a manifold without leakage; and detecting a valve leakage is based on relation between the at least one test value and a threshold value associated with the steady periodic pattern indicative of the manifold without leakage.

17. The non-transitory computer readable medium according to claim 16, the steps further comprising applying a pattern recognition algorithm to the set of pressure data points for determining the test value and for detecting a valve leakage.

* * * * *